US010286331B2

(12) United States Patent
Sakai

(10) Patent No.: US 10,286,331 B2
(45) Date of Patent: May 14, 2019

(54) FUSIBLE TOY BEAD JOINT MEMBER

(71) Applicant: EPOCH COMPANY, LTD., Tokyo (JP)

(72) Inventor: Ryo Sakai, Tokyo (JP)

(73) Assignee: EPOCH COMPANY, LTD., Tokyo (JP)

( * ) Notice: Subject to any disclaimer, the term of this patent is extended or adjusted under 35 U.S.C. 154(b) by 0 days.

(21) Appl. No.: 15/668,077

(22) Filed: Aug. 3, 2017

(65) Prior Publication Data

US 2018/0036647 A1 Feb. 8, 2018

(30) Foreign Application Priority Data

Aug. 5, 2016 (JP) ..... 2016-154335

(51) Int. Cl.

| | |
|---|---|
| ***A63H 33/04*** | (2006.01) |
| ***A63H 33/10*** | (2006.01) |
| ***A63H 33/08*** | (2006.01) |
| ***A63H 33/42*** | (2006.01) |
| ***A63H 33/14*** | (2006.01) |
| *A63H 33/00* | (2006.01) |

(52) U.S. Cl.

CPC ..... *A63H 33/04* (2013.01); *A63H 33/001* (2013.01); *A63H 33/08* (2013.01); *A63H 33/10* (2013.01); *A63H 33/101* (2013.01); *A63H 33/14* (2013.01); *A63H 33/42* (2013.01); *A63H 33/00* (2013.01)

(58) Field of Classification Search

CPC ..... A63H 33/04; A63H 33/10; A63H 33/101; A63H 33/102

See application file for complete search history.

(56) References Cited

U.S. PATENT DOCUMENTS

| | | | |
|---|---|---|---|
| 2,885,822 | A | 5/1959 | Onanian |
| 5,482,491 | A | 1/1996 | Kichijyo |
| 5,871,384 | A | 2/1999 | Kichijo |
| 2013/0183881 | A1 | 7/2013 | Kamiyama |
| 2013/0252503 | A1 | 9/2013 | Kwok et al. |

FOREIGN PATENT DOCUMENTS

| | | | |
|---|---|---|---|
| CN | U-202490448 | | 10/2012 |
| JP | Y2-S49-033597 | | 9/1974 |
| JP | Y2-S50-008712 | | 3/1975 |
| JP | JM-UM-A-S51-051097 | | 4/1976 |
| JP | UM-A-S52-027396 | | 2/1977 |
| JP | Y2-S55-018078 | | 4/1980 |
| JP | 4-285024 | A | 10/1992 |
| JP | UM-A-H07-000497 | | 1/1995 |

(Continued)

OTHER PUBLICATIONS

Office Action dated Nov. 17, 2017 for application GB 1712631.9.

(Continued)

*Primary Examiner* — John Ricci

(74) *Attorney, Agent, or Firm* — Drinker Biddle & Reath LLP

(57) ABSTRACT

A fusible toy bead joint member includes: a flange portion having a flat plate shape; a shaft portion provided to stand from the flange portion; and an insertion portion formed at an end of the shaft portion and formed to be radially larger than the shaft portion. The flange portion, the insertion portion and the shaft portion define a catch recess configured to catch an assembly of a plurality of fusible toy beads made of a water-soluble resin.

6 Claims, 8 Drawing Sheets

(56) References Cited

FOREIGN PATENT DOCUMENTS

| | | |
|---|---|---|
| JP | A-2003-010564 | 1/2003 |
| JP | A-2006-262944 | 10/2006 |
| JP | UM-U-3131292 | 4/2007 |
| JP | A-2009-039181 | 2/2009 |
| JP | A-2013-143986 | 7/2013 |
| WO | WO-A1-96-20033 | 7/1996 |
| WO | WO-A1-2010-116516 | 10/2010 |

OTHER PUBLICATIONS

JP Notification of Reasons for Refusal dated Jan. 26, 2017 that issued in JP patent application No. 2016-154335, along with its English-language translation.

FUSIBLE TOY BEAD JOINT MEMBER

CROSS-REFERENCE TO RELATED APPLICATION(S)

This application is based on and claims priority from Japanese Patent Application No. 2016-154335 filed on Aug. 5, 2016, the entire contents of which are incorporated herein by reference.

BACKGROUND

1. Field of the Invention

One or more embodiments of the present invention relate to a fusible toy bead joint member to be used for enjoying connecting a plurality of assemblies of fusible toy beads to one another.

2. Description of Related Art

Fusible toy beads using granular beads made of a water-soluble resin have been conventionally provided. JP-U-3131292 discloses a bead toy set including a holding tray on which a plurality of recesses are formed to place fusible toy beads therein; a base tray; and a sheet to be inserted between the holding tray and the base tray. Here, a pattern is drawn on this sheet, and when a user places fusible toy beads on the holding tray in accordance with the pattern, he/she can create assemblies of the fusible toy beads in various shapes.

These fusible toy beads are formed into a granular shape by, for example, mixing and kneading polyvinyl alcohol with a resin. After placing the fusible toy beads on the holding tray, when water is supplied thereto with a spray or the like to place the fusible toy beads in a wet state, the fusible toy beads are melted. When the fusible toy beads are dried thereafter by allowing them to stand still for a prescribed period of time, the melted resin is cured, and hence the fusible toy beads are bonded to one another. In this manner, a user, mainly a child, can enjoy creating an assembly of the fusible toy beads in a desired pattern.

JP-A-2003-10564 discloses a joint member to be used for enjoying connecting blocks to each other or connecting a block to another member (such as a doll). This joint member is provided with a joint section including a large number of projections disposed in a substantially dense state. In connecting blocks to each other, the joint section is connected to another joint section with the projections of one joint section inserted into spaces between the projections of the other joint section.

SUMMARY

A child who has created a plurality of assemblies of fusible toy beads in various patterns may want to enjoy connecting these assemblies of the fusible toy beads in some cases. In such a case, if the assemblies of the fusible toy beads are to be connected to each other by connecting a plurality of projections as disclosed in JP-A-2003-10564, it is necessary to provide a member having a plurality of projections in creating each assembly of the fusible toy beads, or to attach such a member with an adhesive or the like after creating the assembly. This is complicated, and imposes restrictions in the creation of the assemblies of the fusible toy beads, which reduces a pleasure of playing with the fusible toy beads.

One or more embodiments of the present invention provide a fusible toy bead joint member capable of easily connecting assemblies of fusible toy beads to each other.

A fusible toy bead joint member according to an aspect includes: a flange portion having a flat plate shape; a shaft portion provided to stand from the flange portion; and an insertion portion formed at an end of the shaft portion and formed to be radially larger than the shaft portion, and the flange portion, the insertion portion and the shaft portion define a catch recess configured to catch an assembly of a plurality of fusible toy beads made of a water-soluble resin.

According to the above-described aspect, if an opening portion is formed in an assembly of fusible toy beads, the assembly of the fusible toy beads can be caught in a catch recess merely by inserting an insertion portion into the opening portion, and thus, a fusible toy bead joint member capable of easily connecting assemblies of the fusible toy beads to each other can be provided.

BRIEF DESCRIPTION OF THE DRAWINGS

FIG. 4A is a plan view thereof and FIG. 4B is a front view taken from arrow P of FIG. 4A with fusible toy beads disposed in a region S of FIG. 4A omitted.

DETAILED DESCRIPTION

Figure 1:
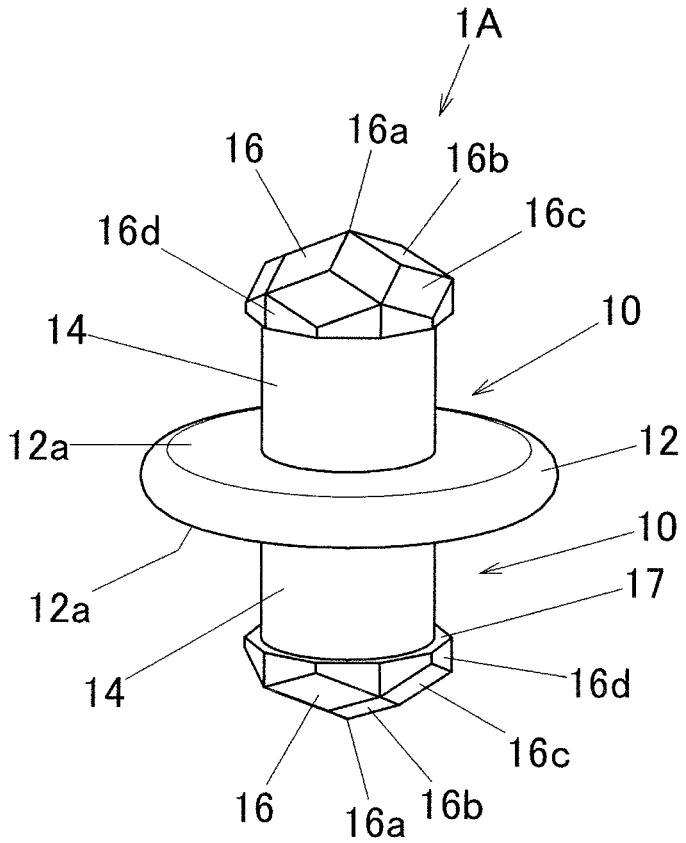
FIG. 1 is a perspective view of a fusible toy bead joint member according to a first embodiment of the present invention.
Figure 2A:
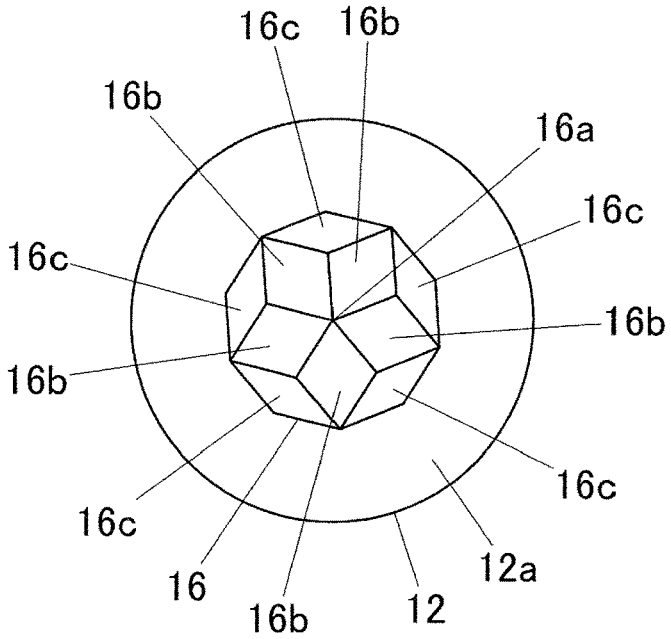
FIGS. 2A and 2B are respectively a plan view and a front view of the fusible toy bead joint member according to the first embodiment of the present invention.
Figure 2B:
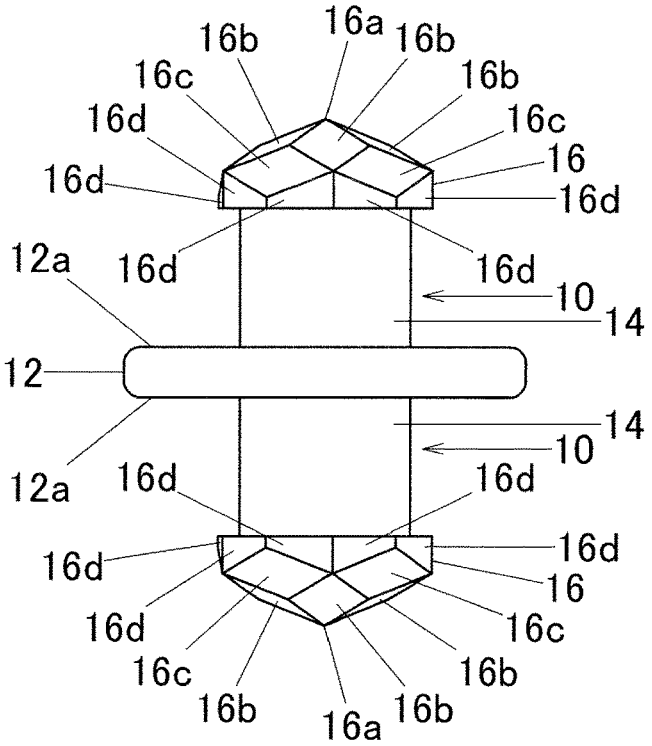

Preferred embodiments of the present invention will now be described with reference to the accompanying drawings. FIGS. 1, 2A and 2B are diagrams illustrating a fusible toy bead joint member 1A according to a first embodiment of the present invention. The fusible toy bead joint member 1A has, in a center thereof, a flange portion 12 in a flat plate shape (specifically, a disc shape). A shaft portion 14 is provided to stand outward from each side surface 12*a* of the flange portion 12. Each shaft portion 14 is in a cylindrical shape. At an end of the shaft portion 14, an insertion portion 16 is formed.

The insertion portion 16 is formed to be radially larger than the shaft portion 14. Specifically, the insertion portion 16 is formed to have a larger diameter than a fusible toy bead

80 illustrated in FIG. 3 described later. The shaft portion 14 is formed to have a smaller diameter than the fusible toy bead 80.

As illustrated in FIGS. 1, 2A and 2B, the insertion portion 16 is in a polygonal shape. In addition, the insertion portion 16 has an apex 16*a* at an outermost end along the shaft direction of the shaft portion 14. Around the apex 16*a*, five first rhombus-shaped surfaces 16*b* are formed. These five first rhombus-shaped surfaces 16*b* are disposed to together form a star shape in a plan view (see FIG. 2A). Around these five first rhombus-shaped surfaces 16*b*, five second rhombus-shaped surfaces 16*c* are disposed. In addition, around these five second rhombus-shaped surfaces 16*c*, ten right angle trapezoidal surfaces 16*d* are disposed. A side of each right angle trapezoidal surface 16*d* disposed on the side of the shaft portion 14 is perpendicular to the shaft direction of the shaft portion 14.

Since the insertion portion 16 radially protrudes from the shaft portion 14 as described above, the insertion portion 16 has a step portion 17 formed on the side of the shaft portion 14. The step portion 17 is formed as a ring-shaped surface perpendicular to the shaft center of the shaft portion 14. Besides, the side surface 12*a* of the flange portion 12, the circumferential surface of the shaft portion 14 and the step portion 17 of the insertion portion 16 together form a catch recess 10. In the fusible toy bead joint member 1A of the present embodiment, two catch recesses 10 are formed to be vertically arranged. Each catch recess 10 is formed in a ring shape around the shaft portion 14.

Figure 3:
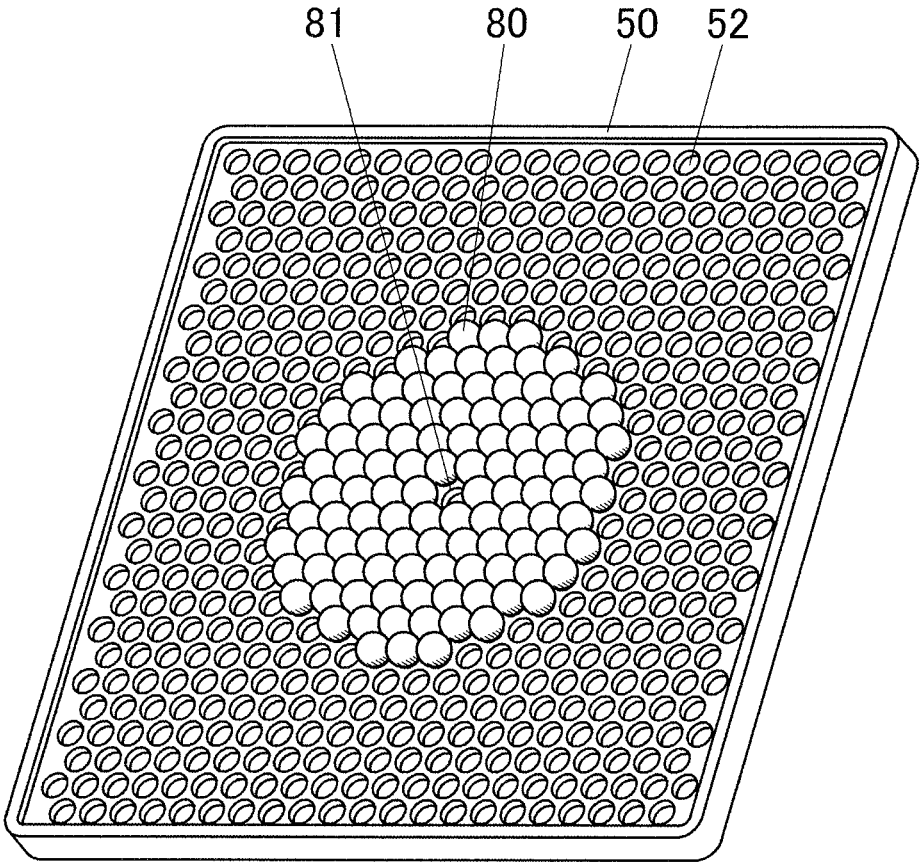
FIG. 3 is a perspective view illustrating an example of a process of creating an assembly of fusible toy beads.

The fusible toy bead joint member 1A having this structure can be used, for example, for an assembly of the fusible toy beads 80 as illustrated in FIG. 3. Here, as the fusible toy beads 80, well-known toy beads are used. For example, each fusible toy bead 80 can be formed by mixing and kneading polyvinyl alcohol with a resin. Although the fusible toy bead in a spherical shape is described in the present embodiment, the fusible toy bead may be alternatively molded into, for example, a polyhedral shape. Besides, fusible toy beads 80 in various colors can be used.

Furthermore, as a holding tray 50, any of holding trays known to be used together with the fusible toy beads 80 is used. The holding tray 50 is formed in the shape of a substantially square plate in a plan view. On the surface of the holding tray 50, a plurality of circular recesses 52 are provided. The recesses 52 are disposed to be offset in different rows (or columns). Thus, six fusible toy beads 80 can be radially placed in the recesses 52 around one fusible toy bead 80 placed in one recess 52. Besides, the diameter of each recess 52 is set to be smaller than the diameter of each fusible toy bead 80, and a distance between the centers of the recesses 52 adjacent to each other is set so that the fusible toy beads 80 disposed in the adjacent recesses 52 can be in contact with each other or slightly spaced from each other. Incidentally, examples of the other known holding trays include one in the shape of a circle or the like, and one having the recesses 52 disposed not to be offset as described above but in parallel.

In the illustrated example, a plurality of fusible toy beads 80 are placed on the holding tray 50 in a substantially circular shape. At the center of the thus formed assembly of the fusible toy beads 80, an opening portion 81 having no fusible toy bead therein is formed. When water is supplied with a spray or the like to the fusible toy beads 80 thus placed on the holding tray 50 and then the resultant fusible toy beads are air dried, the fusible toy beads 80 are bonded to one another to complete the assembly of the fusible toy beads 80 in substantially a circular shape as illustrated in FIG. 3.

Figure 4A:
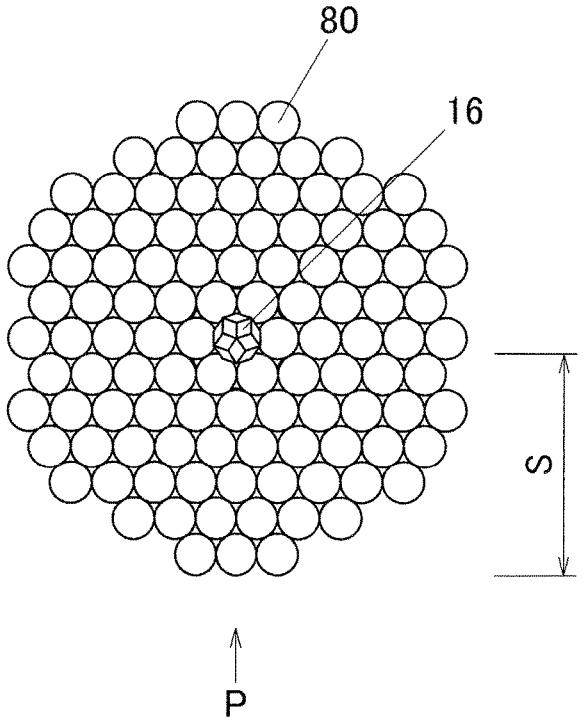
FIGS. 4A and 4B are diagrams illustrating a state where the fusible toy bead joint member according to the first embodiment of the present invention is attached to an assembly of fusible toy beads, and specifically.
Figure 4B:
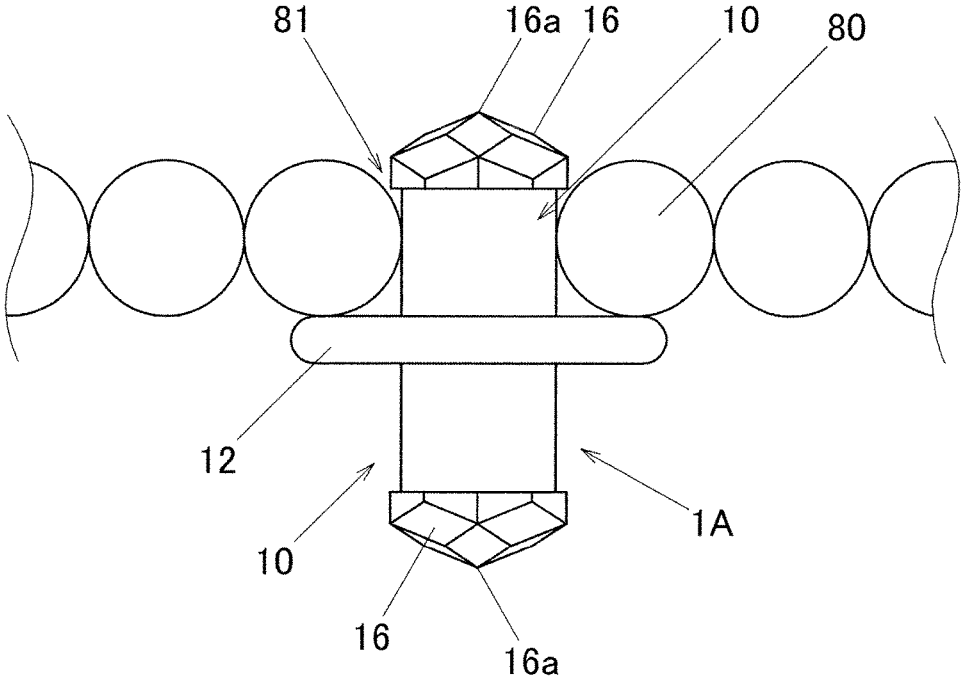

After completing the assembly of the fusible toy beads 80 of FIG. 3, the insertion portion 16 of the fusible toy bead joint member 1A is forcibly inserted into the opening portion 81, resulting in a state illustrated in FIGS. 4A and 4B. Here, FIG. 4B is a side view taken from arrow P with the fusible toy beads 80 disposed in a region S of FIG. 4A omitted.

When the insertion portion 16 on one side of the fusible toy bead joint member 1A is forcibly inserted into the opening portion 81 of the completed assembly of the fusible toy beads 80, the assembly of the fusible toy beads 80 can be caught in the catch recess 10 on this side. In forcibly inserting the insertion portion 16 into the opening portion 81, the insertion portion 16 can be easily inserted into the opening portion 81 because the apex 16*a* is formed in the insertion portion 16. Besides, the flange portion 12 is formed to be sufficiently wide for placing the assembly of the fusible toy beads 80 on its side surface 12*a* when the assembly of the fusible toy beads 80 is caught in the catch recess 10. The protrusion of the insertion portion 16 from the shaft portion 14 is set so that the edge of the step portion 17 can be in contact with the surfaces of the fusible toy beads 80 when the assembly of the fusible toy beads 80 is caught in the catch recess 10. Accordingly, when the assembly of the fusible toy beads 80 is caught in the catch recess 10, the fusible toy bead joint member 1A is sufficiently prevented from coming off from the assembly of the fusible toy beads 80.

Since the fusible toy bead joint member 1A is provided with two catch recesses 10, when the insertion portion 16 on the other side is inserted into an opening portion 81 of another assembly of the fusible toy beads 80 to catch the assembly in the catch recess 10 on this other side, these two different assemblies of the fusible toy beads 80 can be connected to each other.

Incidentally, the opening portion 81 can be formed by forming a space without providing one or more fusible toy beads 80 before supplying water to the plural fusible toy beads 80 for bonding as illustrated in FIG. 3, and alternatively, the opening portion 81 can be formed by removing merely one or more fusible toy beads 80 by cutting with a cutter knife or the like after completing the assembly of the fusible toy beads 80 (after the bonding).

In this manner, when the insertion portions 16 are inserted into the opening portions 81 of the assemblies of the fusible toy beads 80 for catching the assemblies of the fusible toy beads 80 in the catch recesses 10, the assemblies of the fusible toy beads 80 can be connected to each other via the fusible toy bead joint member 1A.

Figure 5:
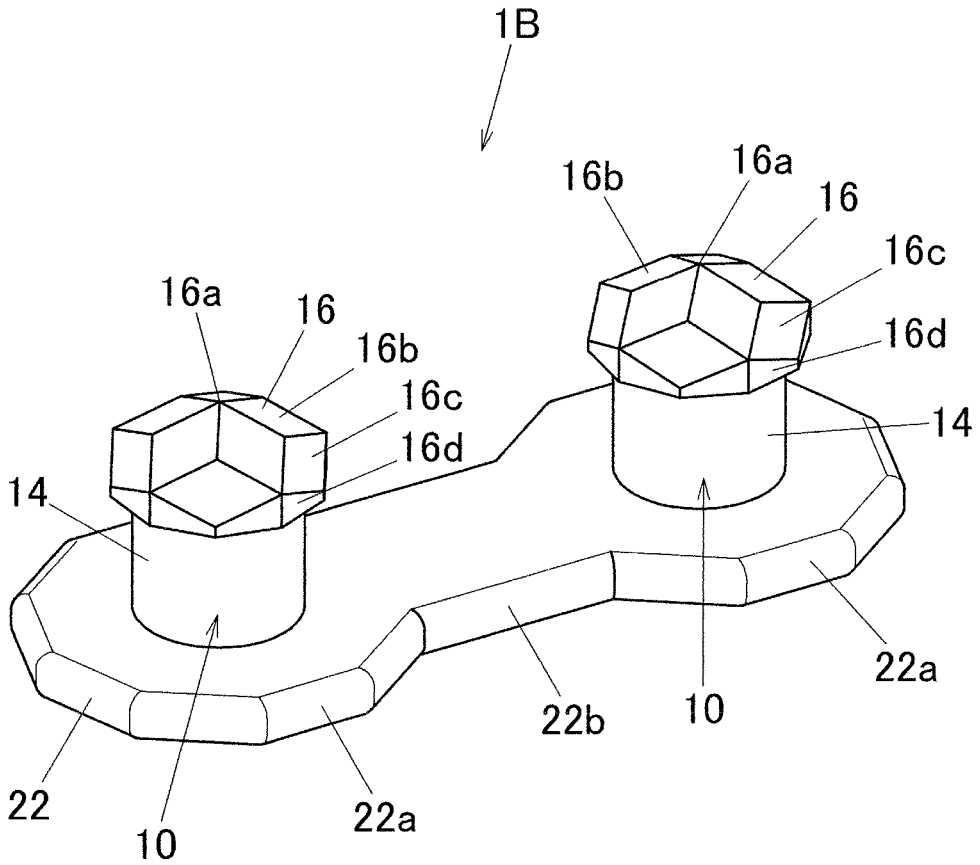
FIG. 5 is a perspective view of a fusible toy bead joint member according to a second embodiment of the present invention.

Next, a fusible toy bead joint member according to a second embodiment of the present invention will be described with reference to FIG. 5. It is noted that like reference signs are used to refer to like elements used in the first embodiment so as to omit or simplify the description. The fusible toy bead joint member 1B of this embodiment includes a connection base 22 in a plate shape in which two flange portions 22*a* are connected to each other through a connection portion 22*b*. Each of the flange portion 22*a* is formed in a polygonal shape in a plan view.

Also in the present embodiment, a catch recess 10 is formed by a step portion 17 (see FIG. 1) of an insertion portion 16, a circumferential surface of a shaft portion 14 and a side surface on one side of the flange portion 22*a*. When the insertion portion 16 is inserted into an opening portion 81 (see FIG. 3) of an assembly of fusible toy beads 80, the assembly of the fusible toy beads 80 are caught in the catch recess 10. Accordingly, if different assemblies of the fusible toy beads 80 are respectively caught in the two catch recesses 10 of the fusible toy bead joint member 1B, these two assemblies of the fusible toy beads 80 can be easily connected to each other.

Figure 6:
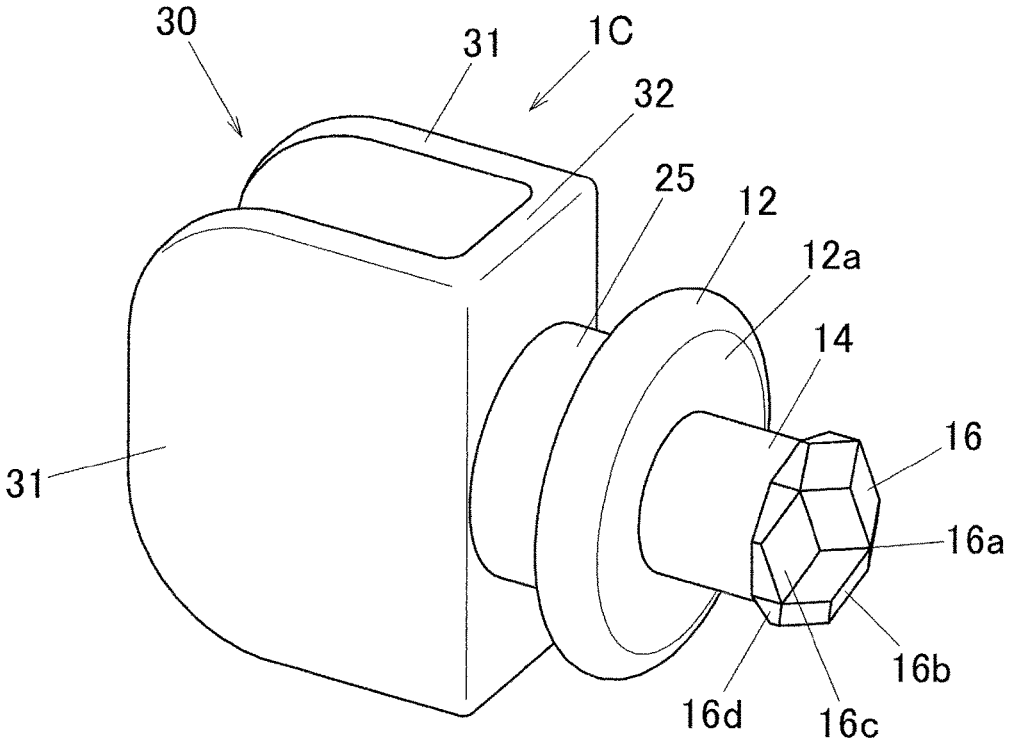
FIG. 6 is a perspective view of a fusible toy bead joint member according to a third embodiment of the present invention.

Next, a fusible toy bead joint member 1C according to a third embodiment of the present invention will be described with reference to FIG. 6. It is noted that like reference signs are used to refer to like elements used in the first embodiment so as to omit or simplify the description.

In the present embodiment, an insertion portion 16 is formed at one end of a shaft portion 14, and the shaft portion 14 is provided to stand on a side surface 12*a* on one side of a flange portion 12 in a flat plate shape (a disc shape) in the same manner as in the first embodiment. Besides, the fusible toy bead joint member 1C of the present embodiment is provided with a nipping portion 30 on the side of the other side surface of the flange portion 12 with a connection shaft 25 sandwiched therebetween. The nipping portion 30 includes two nipping plates 31 opposing each other so as to be in a substantially groove shape when cross-sectionally seen in FIG. 6. The nipping plates 31 are connected to a base plate 32 at their bases. The base plate 32 is connected, on its outside surface (namely, an opposite surface thereof assuming that the surface forming the substantially groove shape is disposed inside), to the connection shaft 25 in a cylindrical shape. The connection shaft 25 is connected to the latter side surface of the flange portion 12. Here, a distance between the nipping plates 31 of the nipping portion 30 is formed to be slightly smaller than the diameter of the fusible toy bead 80.

Figure 7A:
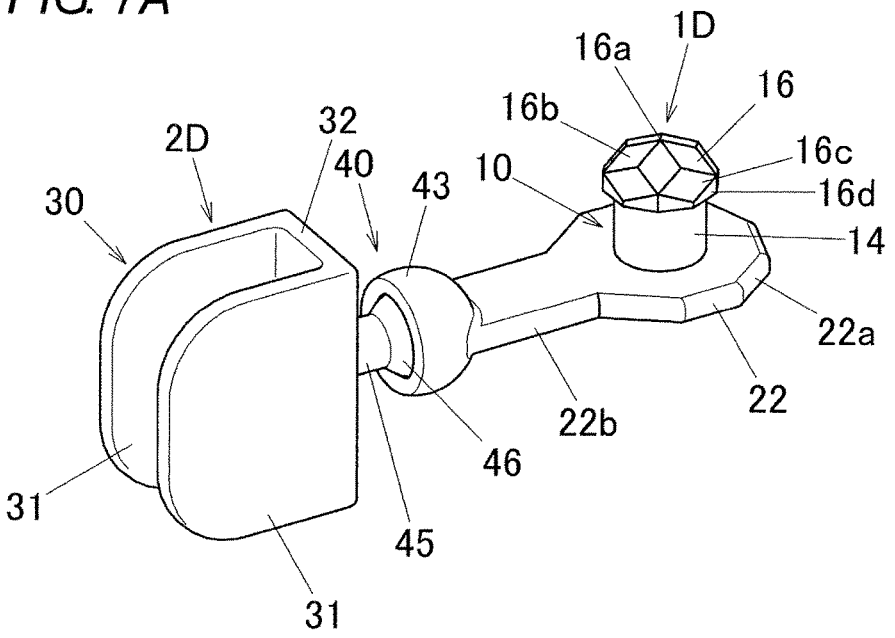
FIGS. 7A and 7B are perspective views of a fusible toy bead joint member and a nip joint according to a fourth embodiment of the present invention.
Figure 7B:
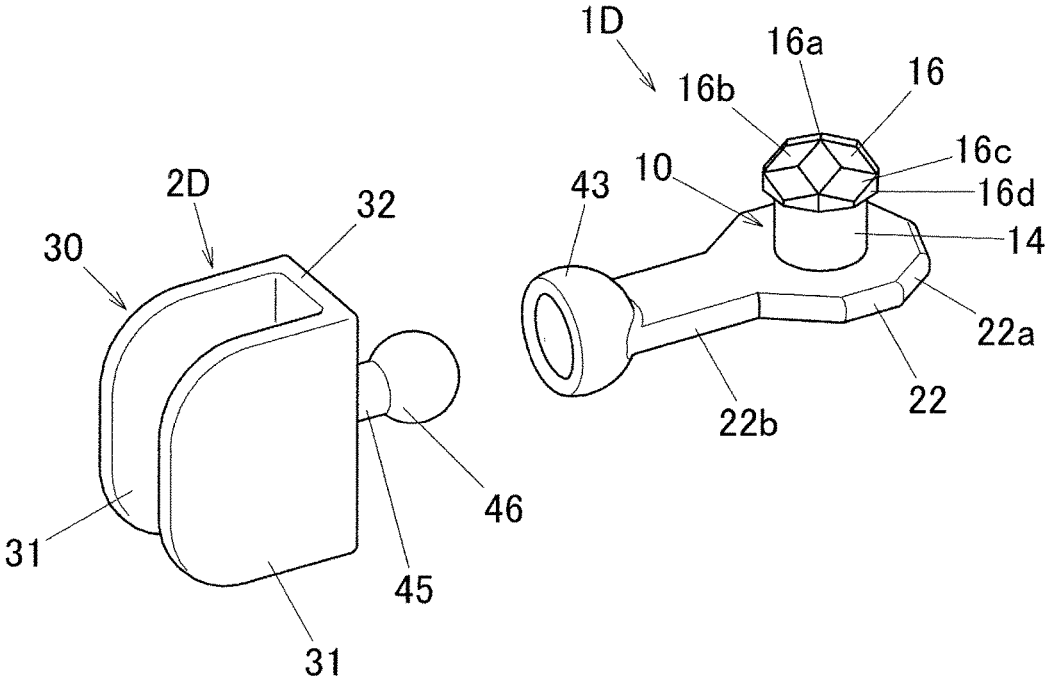

Next, a fusible toy bead joint member according to a fourth embodiment of the present embodiment will be described with reference to FIGS. 7A and 7B. The fusible toy bead joint member 1D of the present embodiment is connected to a nip joint 2D through a ball joint 40. It is noted that like reference signs are used to refer to like elements used in the first to third embodiments so as to omit or simplify the description.

In the present embodiment, a shaft portion 14 is provided to stand from a side surface of a flange portion 22*a* in a polygonal shape in a plan view similarly to that used in the second embodiment, and an insertion portion 16 is formed at an end of the shaft portion 14. The flange portion 22*a* is connected through a connection portion 22*b* to a catching portion 43 constituting the ball joint 40. The catching portion 43 is formed in a bowl shape.

On the other hand, the nip joint 2D includes a nipping portion 30 having the same structure as that of the third embodiment. The nipping portion 30 is connected to the ball portion 46 through a connection shaft 45. The ball portion 46 constituting the ball joint 40 is slidably fit in the catching portion 43 of the fusible toy bead joint member 1D. Accordingly, the fusible toy bead joint member 1D and the nip joint 2D are slidable on each other at any angle owing to the ball joint 40.

Figure 8:
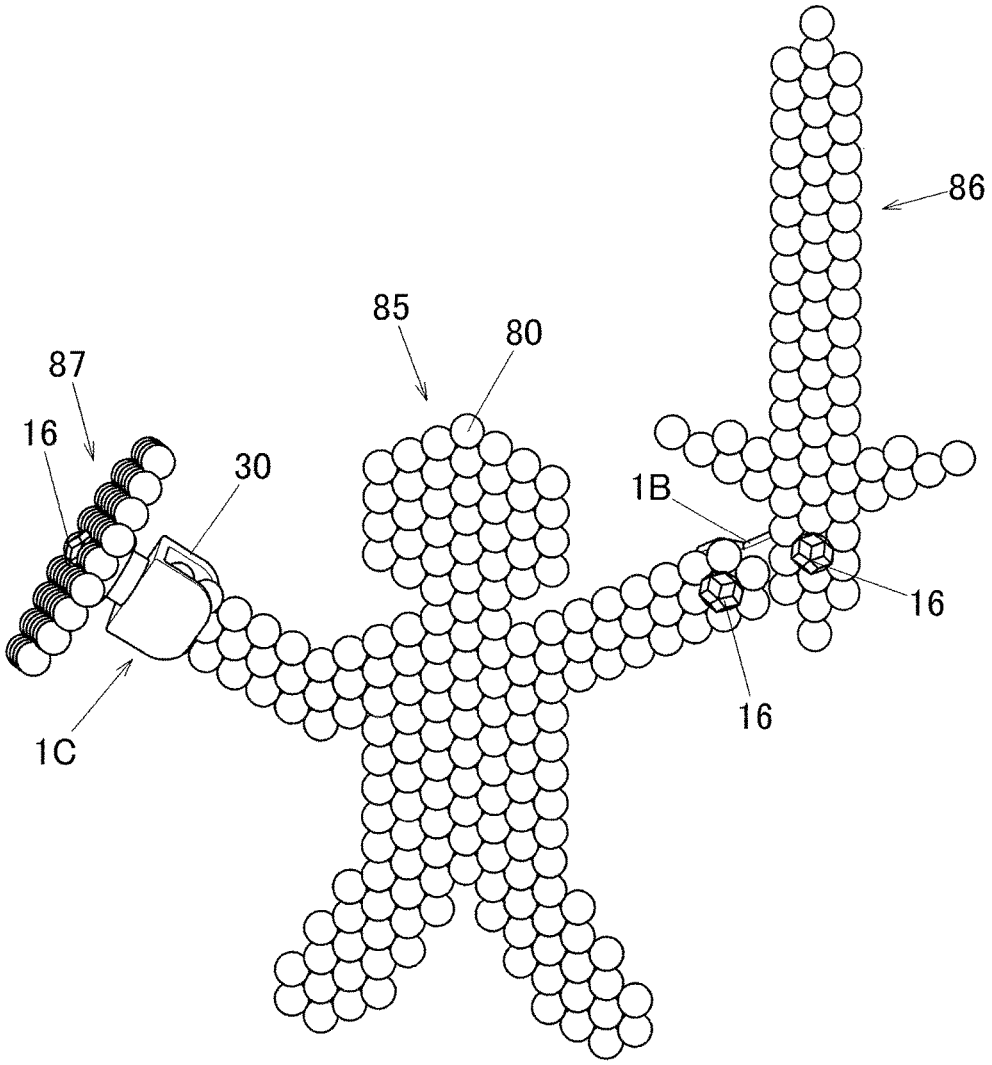
FIG. 8 is a perspective view illustrating a usage example of the fusible toy bead joint members according to the second and third embodiments of the present invention.

The fusible toy bead joint members 1A to 1D having the structures described so far can be used to connect assemblies of the fusible toy beads 30 to each other. If, for example, a human-shaped assembly 85 of the fusible toy beads 80, a sword-shaped assembly 86 of the fusible toy beads 80 and a shield-shaped assembly 87 of the fusible toy beads 80 as illustrated in FIG. 8 are created, the fusible toy bead joint members 1B and 1C can be used to connect these assemblies of the fusible toy beads 80 to one another. Specifically, the fusible toy bead joint member 1B can be used for connecting the sword-shaped assembly 86 of the fusible toy beads 80 to a left hand portion of the human-shaped assembly 85 of the fusible toy beads 80. Besides, the fusible toy bead joint member 1C can be used for connecting the shield-shaped assembly 87 of the fusible toy beads 80 to a right hand portion of the human-shaped assembly 85 of the fusible toy beads 80.

In this manner, each of the fusible toy bead joint members 1A to 1D is provided with two holding portions each for holding an assembly of the fusible toy beads 80, and the catch recess 10 is formed at least one of the holding portions. Therefore, each of the fusible toy bead joint members 1A to 1D can be rigidly held on at least one of assemblies of the fusible toy beads 80 to be connected.

According to the embodiments of the present invention described so far, fusible toy bead joint members of the following aspects can be provided.

A fusible toy bead joint member according to a first aspect includes: a flange portion having a flat plate shape; a shaft portion provided to stand from the flange portion; and an insertion portion formed at an end of the shaft portion and formed to be radially larger than the shaft portion, wherein the flange portion, the insertion portion and the shaft portion define a catch recess configured to catch an assembly of a plurality of fusible toy beads made of a water-soluble resin.

With this structure, if a plurality of assemblies of the fusible toy beads are created, each assembly of the fusible toy beads can be caught in the catch recess merely by inserting the insertion portion into an opening portion of the assembly, and hence, a user can enjoy easily connecting the assemblies of the fusible toy beads to each other.

In the fusible toy bead joint member according to a second aspect, the catch recess has a ring shape around the shaft portion.

When this structure is employed, since the catch recess configured to catch the assembly of the fusible toy beads has a ring shape, all fusible toy beads disposed around the shaft portion can be caught in the catch recess. Accordingly, the assemblies of the fusible toy beads can be more definitely and rigidly connected to each other.

In the fusible toy bead joint member according to a third aspect, an apex is formed at a tip of the insertion portion.

When this structure is employed, the insertion portion can be more easily inserted into the opening portion of the assembly of the fusible toy beads, and hence the fusible toy bead joint member is easier to handle.

In the fusible toy bead joint member according to a fourth aspect, the insertion portion has a polygonal shape.

The shape of the insertion portion can be thus improved in design, and hence, if it is formed, for example, in a star shape in a plan view, the fusible toy bead joint member can be more pleasant to play with.

In the fusible toy bead joint member according to a fifth aspect, the flange portion is provided with a nipping portion capable of holding, by nipping, a part of an assembly of a plurality of fusible toy beads made of the water-soluble resin.

With this structure, the fusible toy bead joint member is connected, on one side, to an assembly of the fusible toy beads through the catch recess, and has, on the other side, the nipping portion capable of holding an edge of another assembly of the fusible toy beads inserted thereinto, and therefore, a user can enjoy a wider variety of connections of assemblies of the fusible toy beads.

In the fusible toy bead joint member according to a sixth aspect, the flange portion is provided with one of a ball portion and a catching portion, which forms a ball joint.

With this structure, a connecting portion between assemblies of the fusible toy beads can be flexibly moved in the fusible toy bead joint member.

The preferred embodiments of the present invention have been described so far, and it is noted that the present invention is not limited to these embodiments but can be practiced in a variety of other embodiments.

What is claimed is:

1. A fusible toy bead joint member comprising:

a flange portion having a flat plate shape;

a shaft portion provided to stand from the flange portion; and an insertion portion formed at an end of the shaft portion to be radially larger than the shaft portion, the insertion portion including a plurality of flat surfaces, wherein the flange portion, the insertion portion and the shaft portion define a catch recess configured to catch an assembly of a plurality of fusible toy beads made of a water-soluble resin.

2. The fusible toy bead joint member according to claim 1, herein the catch recess has a ring shape around the shaft portion.

3. The fusible toy bead joint member according to claim 1, wherein an apex is formed at a tip of the insertion portion.

4. The fusible toy bead joint member according to claim 1, wherein each of the flat surfaces of the insertion portion has a polygonal shape.

5. The fusible toy bead joint member according to claim 1, wherein the flange portion is provided with a nipping portion capable of holding, by nipping, a part of an assembly of a plurality of fusible toy beads made of the water-soluble resin.

6. The fusible toy bead joint member according to claim 1, wherein the flange portion is provided with one of a ball portion and a catching portion, which forms a ball joint.

* * * * *